US007174730B2

(12) United States Patent
Lee

(10) Patent No.: US 7,174,730 B2
(45) Date of Patent: Feb. 13, 2007

(54) METHOD FOR CONTROLLING AIR CONDITIONER HAVING MULTI-COMPRESSOR

(75) Inventor: Won Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 343 days.

(21) Appl. No.: 10/807,318

(22) Filed: Mar. 24, 2004

(65) Prior Publication Data

US 2005/0091997 A1 May 5, 2005

(30) Foreign Application Priority Data

Nov. 4, 2003 (KR) ..... 10-2003-0077615

(51) Int. Cl.
*F25B 7/00* (2006.01)
*F25B 49/00* (2006.01)
*G05D 23/32* (2006.01)

(52) U.S. Cl. ..... 62/175; 62/126; 62/158

(58) Field of Classification Search ..... 62/175, 62/231, 196.2, 126, 157, 158, 510
See application file for complete search history.

(56) References Cited

U.S. PATENT DOCUMENTS 4,633,672 A 1/1987 Persem et al.
6,519,957 B2 2/2003 Huh et al.
2004/0118135 A1 6/2004 Lee et al.

FOREIGN PATENT DOCUMENTS

JP 55-12384 1/1980
JP 03191245 A * 8/1991
JP 9-152197 6/1997
JP 09145130 A * 6/1997
JP 2000213787 A * 8/2000

OTHER PUBLICATIONS

English Language Abstract of JP 9-152197.
English Language Abstract of JP 55-12384.

* cited by examiner

*Primary Examiner*—Chen Wen Jiang
(74) *Attorney, Agent, or Firm*—Greenblum & Bernstein, P.L.C.

(57) ABSTRACT

Disclosed is a method for controlling an air conditioner having a multi-compressor capable of improving an ability that corresponds to a room cooling load or a room heating load and capable of reducing an energy loss of the air conditioner. To this end, a compressing capacity of compressors by a temperature difference between a previous room temperature and a desired temperature predetermined by a user is pre-stored. Then, the pre-stored compressing capacity is varied on the basis of a temperature difference between a present room temperature and the desired temperature.

13 Claims, 3 Drawing Sheets

METHOD FOR CONTROLLING AIR CONDITIONER HAVING MULTI-COMPRESSOR

BACKGROUND OF THE INVENTION

1. Field of the Invention

The present invention relates to an air conditioner, and more particularly, to a method for controlling an air conditioner having a multi-compressor.

2. Description of the Conventional Art

Generally, an air conditioner is for cooling indoor warm air or for warming indoor cool air. An air conditioner having two compressors in accordance with the conventional art will be explained with reference to FIG. 1. Said two compressors are selectively operated according to a room cooling load.

FIG. 1 is a schematic view showing a construction of an air conditioner having two compressors in accordance with the conventional art.

As shown, the air conditioner having two compressors comprises: a first compressor 18A and a second compressor 18B selectively operated by a room cooling load for varying a compressing capacity; a condenser 1 for emitting heat of refrigerant compressed by the first and second compressors 18A and 18B; an expansion valve 2 for expanding refrigerant discharged from the condenser 1; and an evaporator 3 for generating cool air by receiving refrigerant expanded by the expansion valve 2. Hereinafter, the air conditioner having said two compressors will be explained in an assumption that the first compressor 18A is a compressor of a small compressing capacity and the second compressor 18B is a compressor of a high compressing capacity.

Suction pipes 9 and 13 respectively connected to the first and second compressors 18A and 18B are connected to each other by hoses 5 and 7 diverged from a suction hose 4 connected to the evaporator 3. Also, discharge pipes 11 and 14 respectively connected to the first compressor 18A and the second compressor 18B are connected to each other by hoses 10 and 16 diverged from a discharge hose 17 connected to the condenser 1.

To each hose 5, 7, 10, and 16, suction valves 6 and 8 and discharge valves 12 and 15 selectively opened closed by a control means such as a handle operation or a microcomputer are respectively connected.

The air conditioner having said two compressors operates the first compressor 18A and the second compressor 18B by a cooling load thus to control a cooling cycle. More concretely speaking, when a room cooling load is small, the air conditioner operates only the first compressor 18A. On the contrary, when the room cooling load is large, the air conditioner operates only the second compressor 18B. When the room cooling load is maximum, the air conditioner operates both said first compressor 18A and said second compressor 18B thus to vary compressing capacities of the compressors.

Recently, an air conditioner provided with four compressors is being used. The air conditioner of four compressors has the same operation as the air conditioner of FIG. 1. The four compressors are designed to have the same compressing capacity or different compressing capacities.

As a method for controlling the air conditioner of four compressors, as shown in FIG. 2, a compressing capacity of the compressor is increased or decreased step by step (10%) according to a cooling load thus to control a room temperature. For example, when a room temperature reaches a temperature lower than a predetermined desired temperature by 0.5° C. under a state that the air conditioner is in a cooling mode, compressing capacities of the compressors are lowered than the previous compressing capacities by one level thus to operate the compressors for a certain time. After the certain time lapses, the room temperature is compared with the desired temperature again. As the result, if the room temperature is not consistent with the desired temperature, the compressing capacities of the compressors are lowered or raised one level by one level thus to operate the compressors.

However, in the method for controlling the air conditioner, the compressing capacity of the compressors has to be lowered or raised one level by one level according to a room cooling load or a heating load, thereby having a slow speed that corresponds to the cooling load or the heating load and increasing an energy loss. For example, if a compressing capacity of the compressors is to be lowered into 50% from 70% under an assumption that a total compressing capacity of the compressors is 100%, the compressing capacity of 70% has to be lowered into 60% first and then the compressing capacity of 60% has to be lowered into 50%. According to this, a speed that corresponds to the cooling load or the heating load is slow and an energy loss is increased.

The air conditioner having the multi-compressor in accordance with the conventional art has been disclosed in U.S. Pat. No. 6,519,957 registered in Feb. 18, 2003.

SUMMARY OF THE INVENTION

Therefore, an object of the present invention is to provide a method for controlling an air conditioner having a multi-compressor capable of enhancing a correspondence ability to a cooling load or a heating load and reducing an energy loss by pre-storing a compressing capacity of compressors by a temperature difference between a previous room temperature and a desired temperature predetermined by a user and by varying the pre-stored compressing capacity based on a temperature difference between a present room temperature and the desired temperature.

To achieve these and other advantages and in accordance with the purpose of the present invention, as embodied and broadly described herein, there is provided a method for controlling an air conditioner having a multi-compressor comprising the steps of: pre-storing a compressing capacity of compressors by a temperature difference between a previous room temperature and a desired temperature predetermined by a user; and varying the pre-stored compressing capacity based on a temperature difference between a present room temperature and the desired temperature.

In one aspect, a method for controlling an air conditioner having a multi-compressor comprises the steps of: pre-storing a compressing capacity of compressors by a temperature difference between a previous room temperature and a desired temperature; when a present room temperature reaches a lower limit temperature which is less than the desired temperature predetermined by a user under a state that the air conditioner is in a cooling mode, varying the pre-stored compressing capacity into a compressing capacity for maintaining the lower limit temperature and then operating the compressors with the varied compressing capacity; and operating the compressors with the varied compressing capacity for a predetermined time, then detecting a temperature difference between a present room tem perature and the desired temperature, and then re-varying the varied compressing capacity into a predetermined compressing capacity according to the detected temperature difference and thereby operating the compressors.

In another aspect, a method for controlling an air conditioner having a multi-compressor comprises the steps of: pre-storing a compressing capacity of compressors by a temperature difference between a previous room temperature and a desired temperature; when a present room temperature reaches a lower limit temperature which is less than the desired temperature predetermined by a user under a state that the air conditioner is in a cooling mode, varying the pre-stored compressing capacity into a compressing capacity for maintaining the lower limit temperature and then operating the compressors with the varied compressing capacity; operating the compressors with the varied compressing capacity for a predetermined time, then detecting a temperature difference between a present room temperature and the desired temperature, and then re-varying the varied compressing capacity into a predetermined compressing capacity according to the detected temperature difference and thereby operating the compressors; when a compressing capacity corresponding to a present operation mode is equal to a compressing capacity corresponding to a maximum operation mode after varying the compressing capacity of the compressors, operating the compressor in the maximum operation mode; when the compressing capacity corresponding to the present operation mode is smaller than the compressing capacity corresponding to the maximum operation mode, comparing the compressing capacity corresponding to the present operation mode with a compressing capacity corresponding to a previous operation mode, and as the result, if the compressing capacity corresponding to the present operation mode is smaller than the compressing capacity corresponding to the previous operation mode, operating the compressors in the previous operation mode; and when the compressing capacity corresponding to the present operation mode is larger than the compressing capacity corresponding to the previous operation mode, operating the compressors in the present operation mode, wherein the maximum operation mode is a mode for operating the compressors with a total compressing capacity of the multi-compressor, and the previous mode is a mode for operating the compressors with a pre-stored compressing capacity.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, with reference to FIG. 3, will be explained a method for controlling an air conditioner having a multi-compressor capable of enhancing a correspondence ability to a cooling load or a heating load and reducing an energy loss by pre-storing a compressing capacity of compressors by a temperature difference between a previous room temperature and a desired temperature predetermined by a user and by varying the pre-stored compressing capacity based on a temperature difference between a present room temperature and the desired temperature.

Figure 1:
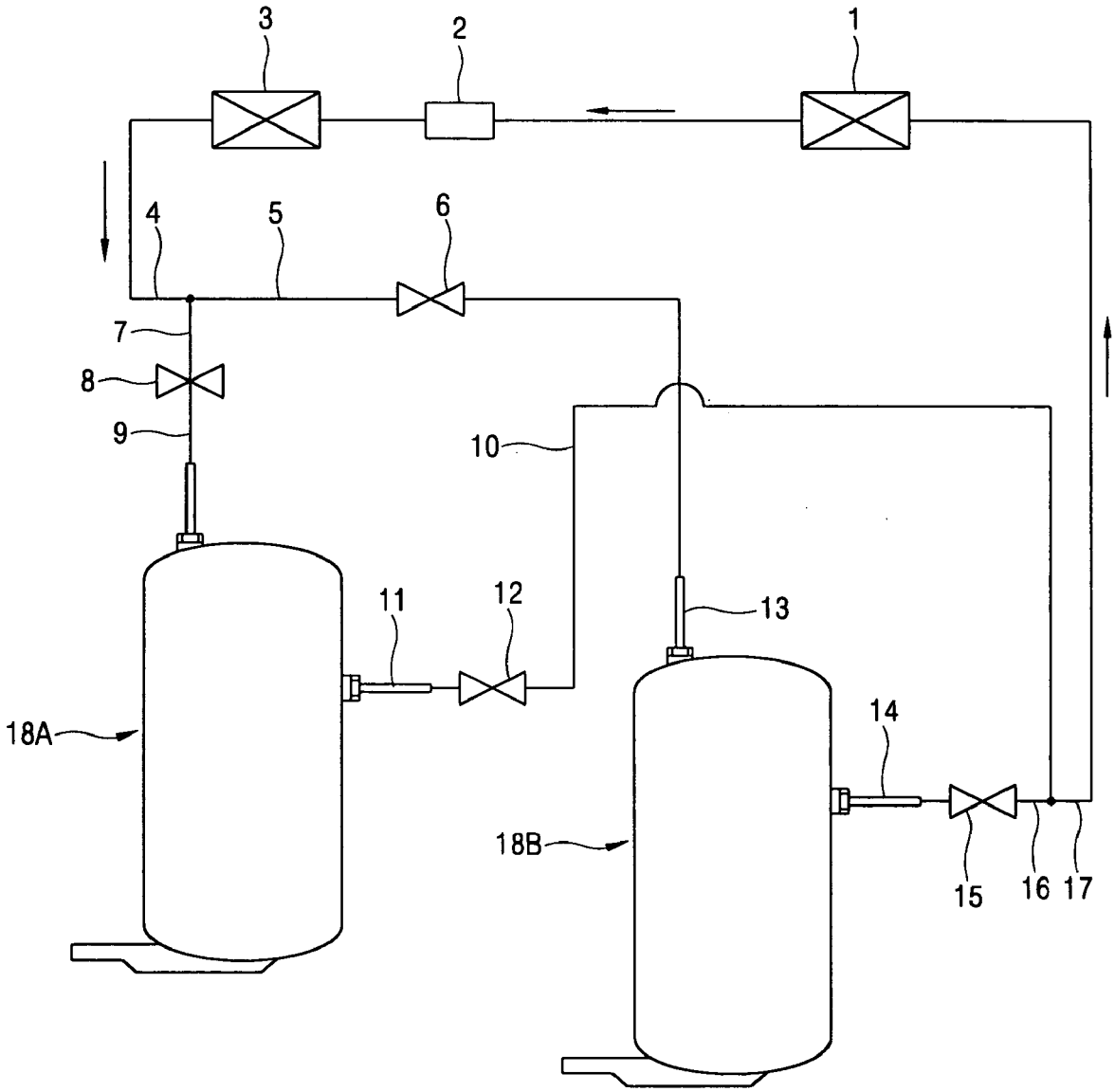
FIG. 1 PRIOR ART
FIG. 1 is a schematic view showing a construction of an air conditioner having two compressors in accordance with the conventional art.
Figure 2:
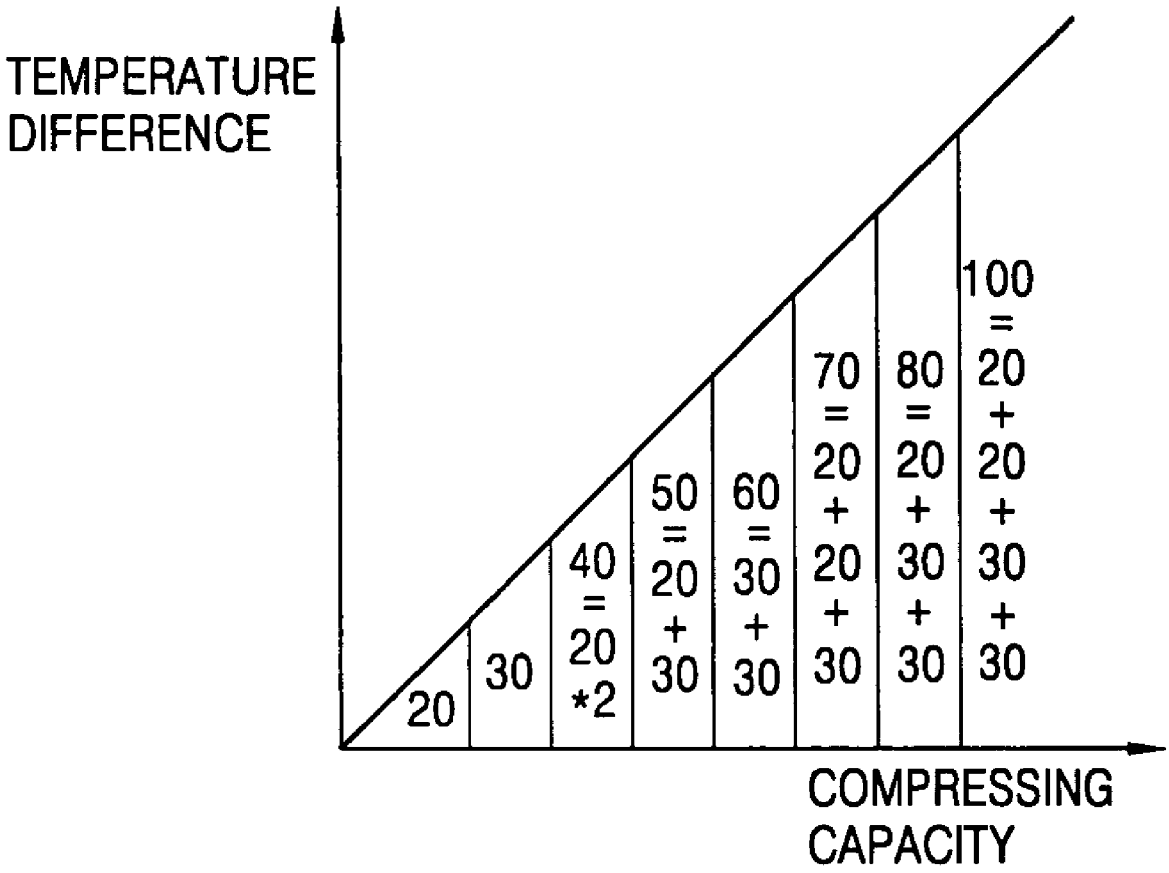
FIG. 2 PRIOR ART
FIG. 2 is a graph showing a method for increasing or decreasing a compressing capacity of the compressor one level by one level according to a temperature difference between a room temperature and a desired temperature in controlling an air conditioner having a plurality of compressors in accordance with the conventional art.
Figure 3:
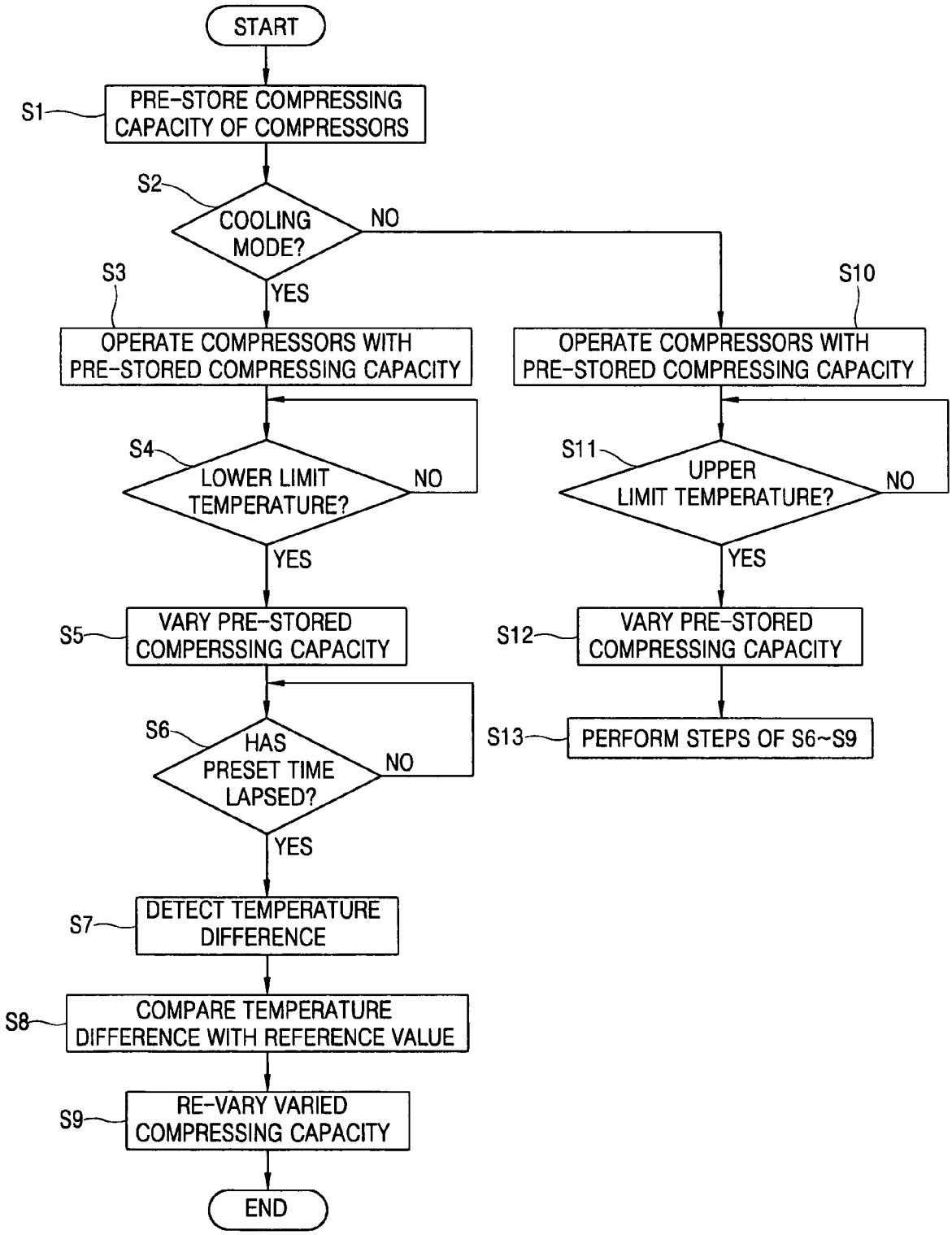
FIG. 3 is a flow chart showing a method for controlling an air conditioner having a multi-compressor according to a preferred embodiment of the present invention.

FIG. 3 is a flow chart showing a method for controlling an air conditioner having a multi-compressor according to a preferred embodiment of the present invention.

As shown, the method for controlling an air conditioner having a multi-compressor according to a preferred embodiment of the present invention comprises the steps of: pre-storing a compressing capacity of compressors by a temperature difference between a previous room temperature and a desired temperature predetermined by a user; when a present room temperature reaches a lower limit temperature which is less than a desired temperature predetermined by a user under a state that the air conditioner is in a cooling mode, varying the pre-stored compressing capacity into a compressing capacity for maintaining the lower limit temperature and then operating the compressors with the varied compressing capacity; and operating the compressors with the varied compressing capacity for a predetermined time, then detecting a temperature difference between the present room temperature and the desired temperature, and then re-varying the varied compressing capacity into a predetermined compressing capacity according to the detected temperature difference and thereby operating the compressors with an optimal compressing capacity.

For example, under an assumption that the multi-compressor is composed of four compressors, a total compressing capacity of the four compressors is 100%, and two compressors having a compressing capacity of 20% and two compressors having a compressing capacity of 30% are respectively installed at the air conditioner, the air conditioner is operated in a cooling mode. While operating two compressors of 20% compressing capacity and one compressor of 30% compressing capacity with a pre-stored compressing capacity, if a present room temperature reaches a lower limit temperature less than a desired temperature by 0.5° C., the compressors of 20% compressing capacity are stopped and one compressor of 20% compressing capacity and one compressor of 30% compressing capacity are operated for a predetermined time (for example, three minutes). Then, a temperature difference between a present room temperature and the desired temperature is detected. According to the detected temperature difference, the varied compressing capacity is re-varied into a predetermined compressing capacity. That is, when the multi-compressor has four compressors and the total compressing capacity of said four compressors is 100%, two compressors of 20% compressing capacity and two compressors of 30% compressing capacity are selectively operated thus to vary the compressing capacity of the multi-compressor.

Also, the method for controlling an air conditioner having a multi-compressor according to a preferred embodiment of the present invention comprises the steps of: when a compressing capacity corresponding to a present operation mode is equal to a compressing capacity corresponding to a maximum operation mode after operating the compressors with a varied compressing capacity, operating the compressor in the maximum operation mode; when the compressing capacity corresponding to the present operation mode is smaller than the compressing capacity corresponding to the maximum operation mode, comparing the compressing capacity corresponding to the present operation mode with a compressing capacity corresponding to a previous operation mode, and as the result, if the compressing capacity corresponding to the present operation mode is smaller than the compressing capacity corresponding to the previous operation mode, operating the compressors in the previous operation mode; and when the compressing capacity corresponding to the present operation mode is larger than the compressing capacity corresponding to the previous operation mode, operating the compressors in the present operation mode, wherein the operation mode is a mode for operating the compressors by varying a compressing capacity of the multi-compressor, the maximum operation mode is a mode for operating the compressors with a total compressing capacity of the multi-compressor, and the previous mode is a mode for operating the compressors with a pre-stored compressing capacity.

Hereinafter, a method for controlling an air conditioner having a multi-compressor according to a preferred embodiment of the present invention will be explained in more detail.

First, at the time of controlling a room temperature in the previous stage, a compressing capacity of the multi-compressor for decreasing a temperature difference between the previous room temperature and a desired temperature predetermined by a user is pre-stored (S1). Herein, the compressing capacity of the compressors is predetermined by a temperature difference between a room temperature and a desired temperature, and is varied. In the preferred embodiment of the present invention, it is assumed that the pre-stored compressing capacity is 70% when the number of compressors applied to the air conditioner is 4 and a total compressing capacity of said four compressors is 100%.

Then, if a cooling mode is selected as a mode of the air conditioner (S2), the compressors are operated with the pre-stored compressing capacity (for example, 70%). While operating the compressors with the pre-stored compressing capacity, if a present room temperature reaches a lower limit temperature which is less than a desired temperature predetermined by the user (S4), the pre-stored compressing capacity is varied into a predetermined compressing capacity for maintaining the lower limit temperature (for example, 50%) (S5). Herein, the lower limit temperature is a temperature near the desired temperature, and is lower than 1° C. (for example, 0.5° C.). For example, when the room temperature is 19.5° C. under an assumption that the desired temperature is 20° C. and the lower limit temperature is 0.5° C., the compressors are operated with the predetermined compressing capacity (for example, 50%) in order to maintain said 19.5° C.

After operating the compressors with the varied compressing capacity (for example, 50%) for a predetermined time (for example, three minutes) (S6), a temperature difference between a present room temperature and the desired temperature is detected (S7).

Then, the temperature difference is compared with a reference value (S8), and the varied compressing capacity (for example, 50%) is varied into a predetermined compressing capacity on the basis of the comparison result. Then, the compressors are operated with said re-varied compressing capacity. That is, if the temperature difference between the present room temperature and the desired temperature is more than a first reference value (for example, 2° C.), the varied compressing capacity (for example, 50%) is raised by two levels (for example, 20%) thus to operate the compressors. If the temperature difference between the present room temperature and the desired temperature is less than the first reference value and more than a second reference value (for example, 1° C.), the varied compressing capacity (for example, 50%) is raised by one level (for example, 10%) thus to operate the compressors. Also, if the temperature difference between the present room temperature and the desired temperature is less than the second reference value (1° C.) and more than a third reference value (for example, 0° C.), the varied compressing capacity (for example, 50%) is maintained as it is thus to operate the compressors. Also, if the temperature difference between the present room temperature and the desired temperature is less than the third reference value (0° C.), the varied compressing capacity (for example, 50%) is lowered by one level (for example, 10%) thus to operate the compressors (S9).

For example, when the air conditioner is in a cooling mode, the compressors are operated with a pre-stored compressing capacity of 70%. During this process, if a present room temperature reaches a lower limit temperature less than a desired temperature by 0.5° C., the compressing capacity of the compressors is varied into 50% from said 70% and the compressors are operated with the varied compressing capacity of 50% for a predetermined time (for example, three minutes). Then, if a temperature difference between the present room temperature and the desired temperature is more than 2° C., the compressing capacity of 50% is increased by 20% thus to operate the compressors. Also, if the temperature difference between the present room temperature and the desired temperature is less than 1~2° C., the compressing capacity of 50% is increased by 10% thus to operate the compressors. Also, if the temperature difference between the present room temperature and the desired temperature is less than 0~1° C., the compressing capacity of 50% is maintained. Also, if the present room temperature is lower than the desired temperature, the compressors are stopped or the compressing capacity of 50% is decreased thus to operate the compressors. Herein, the compressing capacity varied by the temperature difference between the present room temperature and the desired temperature is preset according to a ratio between the number of compressors mounted in the air conditioner and a compressing capacity of the compressors.

Then, the compressing capacity of the compressors is varied, and when a compressing capacity corresponding to a present operation mode for operating the compressors is equal to a compressing capacity corresponding to a maximum operation mode (a maximum compressing capacity (100%) of the multi-compressor), the compressors are operated in the maximum operation mode. Also, if the compressing capacity corresponding to the present operation mode is less than the compressing capacity corresponding to the maximum operation mode, the compressing capacity corresponding to the present operation mode is compared with a compressing capacity corresponding to a previous operation mode. As the result, if the compressing capacity corresponding to the present operation mode is smaller than the compressing capacity corresponding to the previous operation mode, the compressors are operated in the previous operation mode. Also, if the compressing capacity corresponding to the present operation mode is larger than the compressing capacity corresponding to the previous operation mode, the compressors are operated in the present operation mode.

Accordingly, in the present invention, at the time of controlling a room temperature in the previous stage, a compressing capacity by a temperature difference between the previous room temperature and a desired temperature is pre-stored. Then, the pre-stored compressing capacity is varied on the basis of a temperature difference between a present room temperature and the desired temperature. According to this, the compressing capacity of the multi-compressor is quickly varied into an optimal compressing capacity thus to operate the compressors. For example, when a compressing capacity of 70% is to be lowered into 50%, the compressing capacity of 70% is directly lowered into the compressing capacity of 50%. According to this, a speed that corresponds to a cooling load or a heating load is fast, and an energy loss of the air conditioner is reduced.

Also, at the time of controlling a room temperature in the previous stage, a compressing capacity of the compressors by a temperature difference between the previous room temperature and a desired temperature is pre-stored (S1). If a heating mode is selected as a mode of the air conditioner, the compressors are operated with the pre-stored compressing capacity (for example, 70%) (S10). During this process, when a present room temperature reaches an upper limit temperature that is more than a desired temperature predetermined by a user (S11), the pre-stored compressing capacity of the compressors is varied into a predetermined compressing capacity for maintaining the upper limit temperature (S12) thus to operate the compressors with the varied compressing capacity. After operating the compressors with the varied compressing capacity, the above steps (S6~S9) are performed (S13).

As aforementioned, in the method for controlling an air conditioner having a multi-compressor, a compressing capacity by a temperature difference between a previous room temperature and a desired temperature is pre-stored, and then the pre-stored compressing capacity is varied on the basis of a temperature difference between a present room temperature and the desired temperature. According to this, an ability to correspond to a cooling load or a heating load can be improved.

Also, in the method for controlling an air conditioner having a multi-compressor according to the present invention, a compressing capacity by a temperature difference between a previous room temperature and a desired temperature is pre-stored, and then the pre-stored compressing capacity is varied on the basis of a temperature difference between a present room temperature and the desired temperature. According to this, an energy loss of the air conditioner can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for controlling an air conditioner having a multi-compressor comprising:

pre-storing a compressing capacity of compressors by a temperature difference between a previous room temperature and a desired temperature preset by a user; and varying the pre-stored compressing capacity based on a temperature difference between a present room temperature and the desired temperature.

2. The method of claim 1, wherein the pre-stored compressing capacity is varied by selectively operating compressors having the same compressing capacity and compressors having different compressing capacities on the basis of the temperature difference between the present room temperature and the desired temperature.

3. The method of claim 1, wherein in the varying the pre-stored compressing capacity, the pre-stored compressing capacity is varied on the basis of the temperature difference between the present room temperature and the desired temperature in order to increase a speed that corresponds to a cooling load or a heating load.

4. The method of claim 1, wherein the varying the pre-stored compressing capacity comprises:

when the present room temperature reaches a lower limit temperature which is less than the desired temperature preset by a user under a state that the air conditioner is in a cooling mode, varying the pre-stored compressing capacity into a compressing capacity for maintaining the lower limit temperature and then operating the compressors with the varied compressing capacity; and operating the compressors with the varied compressing capacity for a preset time, then detecting a temperature difference between a present room temperature and the desired temperature, and then re-varying the varied compressing capacity into a preset compressing capacity according to the detected temperature difference and thereby operating the compressors.

5. The method of claim 1, wherein the varying the pre-stored compressing capacity comprises:

when the present room temperature reaches an upper limit temperature which is more than the desired temperature under a state that the air conditioner is in a heating mode, varying the pre-stored compressing capacity into a compressing capacity for maintaining the upper limit temperature and then operating the compressors with the varied compressing capacity; and operating the compressors with the varied compressing capacity for a preset time, then detecting a temperature difference between the present room temperature and the desired temperature, and then re-varying the varied compressing capacity into a preset compressing capacity according to the detected temperature difference and thereby operating the compressors.

6. The method of claim 1, wherein the compressing capacity is preset according to a ratio between the number of compressors mounted in the air conditioner and a compressing capacity of the compressors.

7. The method of claim 1 further comprising:

when a compressing capacity corresponding to a present operation mode is equal to a compressing capacity corresponding to a maximum operation mode after varying the compressing capacity of the compressors, operating the compressor in the maximum operation mode;

when the compressing capacity corresponding to the present operation mode is smaller than the compressing capacity corresponding to the maximum operation mode, comparing the compressing capacity corresponding to the present operation mode with a compressing capacity corresponding to a previous operation mode, and as the result, if the compressing capacity corresponding to the present operation mode is smaller than the compressing capacity corresponding to the previous operation mode, operating the compressors in the previous operation mode; and when the compressing capacity corresponding to the present operation mode is larger than the compressing capacity corresponding to the previous operation mode, operating the compressors in the present operation mode, wherein the maximum operation mode is a mode for operating the compressors with a total compressing capacity of the multi-compressor, and the previous mode is a mode for operating the compressors with a pre-stored compressing capacity.

8. A method for controlling an air conditioner having a multi-compressor comprising:

pre-storing a compressing capacity of compressors by a temperature difference between a previous room temperature and a desired temperature;

when a present room temperature reaches a lower limit temperature which is less than a desired temperature preset by a user under a state that the air conditioner is in a cooling mode, varying the pre-stored compressing capacity into a compressing capacity for maintaining the lower limit temperature and then operating the compressors with the varied compressing capacity; and operating the compressors with the varied compressing capacity for a preset time, then detecting a temperature difference between a present room temperature and the desired temperature, and then re-varying the varied compressing capacity into a preset compressing capacity according to the detected temperature difference and thereby operating the compressors.

9. The method of claim 8, wherein the re-varying the varied compressing capacity and thereby operating the compressors comprises:

when a temperature difference between the present room temperature and the desired temperature is more than a first reference value, increasing the varied compressing capacity by a first preset value;

when the temperature difference between the present room temperature and the desired temperature is less than the first reference value and more than a second reference value, increasing the varied compressing capacity by a second preset value;

when the temperature difference between the present room temperature and the desired temperature is less than the second reference value and more than a third reference value, maintaining the varied compressing capacity; and when the temperature difference between the present room temperature and the desired temperature is less than the third reference value, decreasing the varied compressing capacity by the first preset value.

10. The method of claim 9, wherein the first reference value is 2°, the second reference value is 1°, and the third reference value is 0°.

11. The method of claim 8, wherein the compressing capacity is preset according to a ratio between the number of compressors mounted in the air conditioner and a compressing capacity of the compressors.

12. The method of claim 8 further comprising:

when a compressing capacity corresponding to a present operation mode is equal to a compressing capacity corresponding to a maximum operation mode after varying the compressing capacity of the compressors, operating the compressor in the maximum operation mode;

when the compressing capacity corresponding to the present operation mode is smaller than the compressing capacity corresponding to the maximum operation mode, comparing the compressing capacity corresponding to the present operation mode with a compressing capacity corresponding to a previous operation mode, and as the result, if the compressing capacity corresponding to the present operation mode is smaller than the compressing capacity corresponding to the previous operation mode, operating the compressors in the previous operation mode; and when the compressing capacity corresponding to the present operation mode is larger than the compressing capacity corresponding to the previous operation mode, operating the compressors in the present operation mode, wherein the maximum operation mode is a mode for operating the compressors with a total compressing capacity of the multi-compressor, and the previous mode is a mode for operating the compressors with a pre-stored compressing capacity.

13. A method for controlling an air conditioner having a multi-compressor comprising:

pre-storing a compressing capacity of compressors by a temperature difference between a previous room temperature and a desired temperature;

when a present room temperature reaches a lower limit temperature which is less than a desired temperature preset by a user under a state that the air conditioner is in a cooling mode, varying the pre-stored compressing capacity into a compressing capacity for maintaining the lower limit temperature and then operating the compressors with the varied compressing capacity;

operating the compressors with the varied compressing capacity for a preset time, then detecting a temperature difference between a present room temperature and the desired temperature, and then re-varying the varied compressing capacity into a preset compressing capacity according to the detected temperature difference and thereby operating the compressors;

when a compressing capacity corresponding to a present operation mode is equal to a compressing capacity corresponding to a maximum operation mode after varying the compressing capacity of the compressors, operating the compressor in the maximum operation mode;

when the compressing capacity corresponding to the present operation mode is smaller than the compressing capacity corresponding to the maximum operation mode, comparing the compressing capacity corresponding to the present operation mode with a compressing capacity corresponding to a previous operation mode, and as the result, if the compressing capacity corresponding to the present operation mode is smaller than the compressing capacity corresponding to the previous operation mode, operating the compressors in the previous operation mode; and when the compressing capacity corresponding to the present operation mode is larger than the compressing capacity corresponding to the previous operation mode, operating the compressors in the present operation mode, wherein the maximum operation mode is a mode for operating the compressors with a total compressing capacity of the multi-compressor, and the previous mode is a mode for operating the compressors with a pre-stored compressing capacity.

* * * * *